US011628334B2

(12) United States Patent
Briscoe

(10) Patent No.: US 11,628,334 B2
(45) Date of Patent: Apr. 18, 2023

(54) DIP APPARATUS, METHODS, AND SYSTEMS

(71) Applicant: Tricep-Tore, LLC, Frederick, MD (US)

(72) Inventor: Cashton Briscoe, Frederick, MD (US)

(73) Assignee: Tricep-Tore, LLC, Frederick, MD (US)

( * ) Notice: Subject to any disclaimer, the term of this patent is extended or adjusted under 35 U.S.C. 154(b) by 45 days.

(21) Appl. No.: 17/353,050

(22) Filed: Jun. 21, 2021

(65) Prior Publication Data

US 2021/0402254 A1 Dec. 30, 2021

Related U.S. Application Data

(60) Provisional application No. 63/044,389, filed on Jun. 26, 2020.

(51) Int. Cl.
*A63B 23/12* (2006.01)
*A63B 21/04* (2006.01)
(Continued)

(52) U.S. Cl.
CPC .... *A63B 23/1227* (2013.01); *A63B 21/00181* (2013.01); *A63B 21/0414* (2013.01);
(Continued)

(58) Field of Classification Search
CPC ..... A63B 23/1209; A63B 23/1218; A63B 23/1227; A63B 23/1236; A63B 21/4035;
(Continued)

(56) References Cited

U.S. PATENT DOCUMENTS 2,666,640 A * 1/1954 Jennings, Sr. ..... A63B 3/00 482/141
2,673,737 A * 3/1954 Daniels ..... A63B 23/0233 482/130

(Continued)

FOREIGN PATENT DOCUMENTS

WO 2013047584 4/2013

OTHER PUBLICATIONS

STIC search (Year: 2022).*

(Continued)

*Primary Examiner* — Megan Anderson
*Assistant Examiner* — Thao N Do
(74) *Attorney, Agent, or Firm* — Bass Patent Law, LLC

(57) ABSTRACT

A collapsible and portable dip apparatus may be structurally configured for use with one or more resistance bands for adjusting the intensity of exercises. Specifically, a dip apparatus according to the present teachings may include side structures that are pivotable towards a central support structure to reduce a footprint of the dip apparatus, e.g., for storage. Further, the side structures may include support bars that are structurally configured for engagement with a resistance band, where the support bars are located below gripping bars of the dip apparatus. To this end, the present teachings include an exercise system featuring the aforementioned dip apparatus and resistance bands, where a user can engage a resistance band with each of the side structures of the dip apparatus such that a user can place his/her knees on the resistance band for support when performing a dip exercise.

14 Claims, 5 Drawing Sheets

(51) Int. Cl.

| | |
|---|---|
| ***A63B 21/00*** | (2006.01) |
| ***A63B 21/055*** | (2006.01) |
| ***A61H 3/00*** | (2006.01) |
| ***A63B 71/00*** | (2006.01) |
| ***A61H 3/04*** | (2006.01) |

(52) U.S. Cl.
CPC ..... *A63B 21/0557* (2013.01); *A63B 21/4035* (2015.10); *A61H 3/00* (2013.01); *A61H 3/04* (2013.01); *A61H 2201/1261* (2013.01); *A63B 21/00047* (2013.01); *A63B 21/00061* (2013.01); *A63B 21/4027* (2015.10); *A63B 71/0009* (2013.01); *A63B 2210/50* (2013.01); *A63B 2225/09* (2013.01)

(58) Field of Classification Search
CPC ..... A63B 21/00181; A63B 21/0414; A63B 21/0552; A63B 21/0555; A63B 21/0557; A63B 21/00061; A63B 21/4005; A63B 21/4007; A63B 21/4017; A63B 21/4019; A63B 21/4021; A63B 21/4023; A63B 21/4033; A63B 21/4027; A63B 2225/09; A63B 2225/093; A63B 2210/50; A63B 71/0009; A61H 3/00; A61H 3/04; A61H 2201/1261
USPC ..... 482/130, 96
See application file for complete search history.

(56) References Cited

U.S. PATENT DOCUMENTS 2,817,387 A * 12/1957 Blake ..... A61H 3/00 135/67
3,716,231 A * 2/1973 Martin ..... A63B 17/00 482/38
4,846,458 A 7/1989 Potts
4,927,138 A * 5/1990 Ferrari ..... A63B 69/0035 482/41
5,011,139 A 4/1991 Towley, III
5,096,187 A * 3/1992 Marples ..... A63B 23/12 482/41
RE34,212 E 4/1993 Potts
5,242,340 A 9/1993 Jerome
5,275,187 A * 1/1994 Davis ..... A61H 3/00 482/66
5,322,489 A 6/1994 Webb et al.
5,372,556 A 12/1994 Ropp
5,407,404 A 4/1995 Killian et al.
5,554,083 A 9/1996 Chen
5,579,793 A * 12/1996 Gajewski ..... A61H 3/00 135/74
5,876,311 A * 3/1999 Coates ..... A63B 21/023 297/274
5,961,430 A * 10/1999 Zuckerman ..... A63B 21/00047 482/141
6,248,048 B1 * 6/2001 Zuckerman ..... A63B 21/00047 482/141
7,104,939 B1 * 9/2006 Martinez ..... A63B 21/4045 482/148
7,217,227 B2 5/2007 Finn
7,534,200 B1 * 5/2009 Martinez ..... A63B 23/02 482/142
7,651,449 B1 * 1/2010 Balentine ..... A63B 21/4035 482/141
7,918,770 B1 4/2011 Hoole
7,955,238 B2 * 6/2011 Dokshutsky ..... A63B 21/0552 482/121
D701,581 S * 3/2014 Heitzman ..... D21/691
8,936,537 B2 1/2015 Hoole
9,259,612 B2 2/2016 Meister et al.
9,265,686 B1 * 2/2016 Pichnarcik ..... A63B 21/0552
9,486,383 B1 * 11/2016 Pichnarcik ..... A63B 21/0442
9,579,249 B2 * 2/2017 Fulkerson ..... A61H 3/04
9,776,030 B1 * 10/2017 Louis ..... A63B 5/11
9,895,281 B1 * 2/2018 Sigsworth ..... A61H 3/00
10,183,194 B1 * 1/2019 Louis ..... A63B 21/023
10,293,202 B2 * 5/2019 Hoobler ..... A63B 21/4035
10,434,366 B2 10/2019 Dungee
10,525,300 B1 * 1/2020 Boatwright ..... A63B 1/00
10,576,322 B2 3/2020 Schlegel
10,857,058 B1 * 12/2020 Casibang ..... A61H 3/04
10,864,132 B1 * 12/2020 Bingham ..... A61H 3/00
2003/0004042 A1 * 1/2003 Burrell ..... A63B 21/00047 482/121
2004/0067827 A1 * 4/2004 Tustin ..... A63B 21/0552 482/121
2004/0127339 A1 * 7/2004 Finn ..... A63B 21/00181 482/124
2005/0003938 A1 * 1/2005 Henderson ..... A63B 21/4035 482/142
2005/0113221 A1 * 5/2005 Dovner ..... A63B 21/0552 482/121
2005/0261114 A1 * 11/2005 Heitzman ..... A47C 9/002 482/148
2006/0079378 A1 * 4/2006 Ader ..... A63B 71/0009 482/142
2008/0108487 A1 * 5/2008 Bizzell ..... A63B 21/0004 482/142
2008/0176727 A1 * 7/2008 Heitzman ..... A47C 4/54 482/142
2009/0120479 A1 * 5/2009 McCarthy ..... A61H 3/04 224/407
2010/0331155 A1 * 12/2010 Gorsuch ..... A63B 21/00047 482/142
2011/0118095 A1 * 5/2011 Perry, Jr. ..... A63B 21/4011 482/142
2011/0190103 A1 * 8/2011 Nguyen ..... A63B 21/4047 482/139
2011/0275499 A1 11/2011 Eschenbach
2012/0138113 A1 * 6/2012 Spinabella ..... A47B 97/00 108/50.14
2013/0167888 A1 * 7/2013 LoSasso ..... A63B 71/0622 135/66
2014/0087928 A1 * 3/2014 Luedeka ..... A63B 21/4023 482/130
2014/0371038 A1 * 12/2014 Markowitz ..... A63B 21/0414 482/123
2015/0273263 A1 * 10/2015 Guttman ..... A63B 21/068 482/129
2015/0328493 A1 * 11/2015 Ertl ..... A47C 16/02 108/50.11
2016/0287968 A1 * 10/2016 Brady ..... A63B 21/068
2017/0072242 A1 * 3/2017 Drain, II ..... A63B 23/0405
2017/0144008 A1 * 5/2017 Brown ..... A63B 3/00
2018/0036571 A1 * 2/2018 Channer ..... A63B 23/0211
2018/0221700 A1 * 8/2018 George ..... A63B 23/0355
2018/0361201 A1 * 12/2018 Dungee ..... A63B 21/068
2019/0351278 A1 * 11/2019 Walker ..... A63B 21/00061
2020/0023223 A1 * 1/2020 Rosenthal ..... A63B 21/4043
2020/0147434 A1 * 5/2020 Garcia, Jr. ..... A63B 21/0004
2020/0305611 A1 * 10/2020 Singer ..... A63B 23/0458
2020/0352400 A1 * 11/2020 Grendel ..... A47K 11/04
2020/0397643 A1 * 12/2020 Bailey ..... A61H 3/04
2021/0154083 A1 * 5/2021 Downes ..... A61H 3/00
2021/0283461 A1 * 9/2021 Aref ..... A63B 21/4015
2022/0219041 A1 * 7/2022 Briscoe ..... A63B 21/00061

OTHER PUBLICATIONS

"20 Dip Variations: 4 Assisted Dips & 16 Advanced Dip Variations," King of the Gym, https://www.kingofthegym.com/dip-variations/, May 18, 2018, 11 pages.
Dark Iron Fitness, "Chest Exercises with Resistance Bands" https://darkironfitness.com/chest-exercises-with-resistance-bands/, Feb. 14, 2018, 13 pages.
Dumboro, "CoreX Functional Fitness Parallette Dip Station. Dip Bars" Jun. 21, 2021, 4 pages.

(56) References Cited

OTHER PUBLICATIONS

Groupon, "Dip Bar Dipping Station Fitness Strength Training Exercise w Sling Loops," Jun. 21, 2021, 3 pages.
YouTube "Dips on Parallel Bars (with rubber band)—Kubebarz DEMO," https://www.youtube.com/watch?v=FRtjWwSbjUY, 1 page, Jun. 9, 2016.
YouTube, "Assisted Dip with Resistance Band," https://www.youtube.com/watch?v=xzC1eXZKIUQ, Aug. 27, 2013, 1 page.
YouTube, "Dip Burnout Sets With Bands: Tricep Exercise/Workout," https://www.youtube.com/watch?v=Gk1jv2YFm50, Oct. 14, 2015, 1 page.

* cited by examiner

DIP APPARATUS, METHODS, AND SYSTEMS

CROSS-REFERENCE TO RELATED APPLICATIONS

This application claims priority to U.S. Provisional Application No. 63/044,389 filed on Jun. 26, 2020, the entire content of which is hereby incorporated by reference.

FIELD

The present disclosure generally relates to devices, systems, and techniques for exercises such as dip exercises, e.g., a collapsible and portable dip apparatus that can be used in conjunction with one or more resistance bands for performing different exercises and/or for adjusting the intensity of exercises.

BACKGROUND

"Dips" are generally bodyweight exercises that work the triceps as well as muscles of the chest and shoulders. The exercise is called a "dip" because a user lowers their body between gripping regions (e.g., parallel bars) as they attempt to bend their elbows to an angle of approximately 90 degrees and return to an upright position where their elbows are approximately 180 degrees. Dips can be a challenging (or impossible) exercise for users with poor upper body strength and/or excessive lower body weight. Existing dip machines that provide support for such users—which are typically located in commercial or professional gyms because of their bulk and expense—can be equipped with weights, cables, and the like that allow a user to select how much upward assistance they need or desire to complete an exercise. Depending on the model of dip machine that includes such upward assistance, a user typically stands or kneels on a platform that is connected to weights by pulleys (or similar) to provide upward assistance while performing the dip exercise. These machines are typically designed for both pullups and dips, and they are usually bulky, non-portable, and/or expensive.

Dip exercise devices that are less bulky and less expensive than the aforementioned dip machines are available, e.g., for home use and the like. Typically, these dip exercise devices include setups featuring waist-high stands having an upper parallel bar portion for a user to grasp and perform dips while bending their knees so as to maintain their body above the floor. Often, these devices lack stability (e.g., they can be "shaky" and unstable for many users), they include a footprint that is not easily adjustable for storage and the like, and they lack any means for providing support for users that cannot (or do not desire to) use their entire body weight when performing a dip exercise.

There remains a need for improved devices, systems, and techniques for dip exercises.

SUMMARY

A collapsible and portable dip apparatus may be structurally configured for use with one or more resistance bands for adjusting the intensity of exercises. Specifically, a dip apparatus according to the present teachings may include side structures that are pivotable towards a central support structure to reduce a footprint of the dip apparatus, e.g., for storage. Further, the side structures may include support bars that are structurally configured for engagement with a resistance band, where the support bars are located below gripping bars of the dip apparatus. To this end, the present teachings include an exercise system featuring the aforementioned dip apparatus and resistance bands, where a user can engage a resistance band with each of the side structures of the dip apparatus such that a user can place his/her knees on the resistance band for support when performing a dip exercise.

In an aspect, an exercise system disclosed herein includes collapsible and portable dip apparatus. The dip apparatus may include a first side structure including: a first gripping bar supported by a first leg and a second leg, where the first leg and the second leg are adjustable along a z-axis to relocate the first gripping bar along the z-axis; and a first support bar connecting the first leg and the second leg, the first support bar disposed below the first gripping bar along the z-axis. The dip apparatus may further include a second side structure disposed opposite the first side structure and aligned substantially parallel to the first side structure when the dip apparatus is positioned for a dip exercise, the second side structure including: a second gripping bar disposed opposite the first gripping bar, the second gripping bar supported by a third leg and a fourth leg, where the third leg and the fourth leg are adjustable along the z-axis to relocate the second gripping bar along the z-axis; and a second support bar connecting the third leg and the fourth leg, the second support bar disposed below the second gripping bar along the z-axis. The dip apparatus may also include a central support structure connecting the first side structure to the second side structure, where each of the first side structure and the second side structure are pivotable towards the central support structure thereby reducing a footprint of the dip apparatus when the dip apparatus is positioned for storage. The exercise system may also include one or more resistance bands, where a resistance band of the one or more resistance bands is structurally configured to engage with the first support bar and the second support bar.

Implementations may include one or more of the following features. The resistance band may include a first end and a second end, where each of the first end and the second end is structurally configured to engage with the first support bar and the second support bar. The resistance band may include a hook disposed on each of the first end and the second end. The resistance band may include a first end including a first connector and a second end including a second connector, where the first connector and the second connector are attachable to one another. One or more of the first connector and the second connector may include a clip. One or more of the first connector and the second connector may include a hook. The first connector may include a protrusion, where the second connector includes a void to receive the protrusion. The resistance band may be made from an elastic material. The resistance band may be made from rubber. The resistance bands may include at least two resistance bands each having a different modulus of elasticity. The resistance bands may include three or more resistance bands, where each of the three or more resistance bands has a different modulus of elasticity. The first leg, the second leg, the third leg, and the fourth leg may be independently adjustable along the z-axis. The first leg and the second leg may adjust in a cooperating manner, and the third leg and the fourth leg may adjust in a cooperating manner. The first support bar and the second support bar may each be adjustable along the z-axis. Each of the first gripping bar and the second gripping bar may include a handle. The handle may include a gripping region disposed along each of the first gripping bar and the second gripping bar. The gripping region may include a softer material than that of the first gripping bar and the second gripping bar. The gripping region may include a foam material. The handle may protrude from the first gripping bar and the second gripping bar. The handle may include an indention in the first gripping bar and the second gripping bar.

In an aspect, a collapsible and portable dip apparatus disclosed herein may include: a first side structure including a first gripping bar supported by a first leg and a second leg, where the first leg and the second leg are adjustable along a z-axis to relocate the first gripping bar along the z-axis, and a first support bar connecting the first leg and the second leg, the first support bar disposed below the first gripping bar along the z-axis. The dip apparatus may further include a second side structure disposed opposite the first side structure and aligned substantially parallel to the first side structure when the dip apparatus is positioned for a dip exercise, the second side structure including: a second gripping bar disposed opposite the first gripping bar, the second gripping bar supported by a third leg and a fourth leg, where the third leg and the fourth leg are adjustable along the z-axis to relocate the second gripping bar along the z-axis; and a second support bar connecting the third leg and the fourth leg, the second support bar disposed below the second gripping bar along the z-axis. The dip apparatus may also include a central support structure connecting the first side structure to the second side structure, where each of the first side structure and the second side structure are pivotable towards the central support structure thereby reducing a footprint of the dip apparatus when the dip apparatus is positioned for storage. Each of the first support bar and the second support bar may be structurally configured for engagement with one or more resistance bands.

In an aspect, a method disclosed herein may include: engaging a resistance band to a first support bar and a second support bar of a dip apparatus, where the dip apparatus includes a first side structure including a first gripping bar supported by a first leg and a second leg, and the first support bar, where the first support bar connects the first leg and the second leg, and where the first support bar is disposed below the first gripping bar along an z-axis; a second side structure including a second gripping bar supported by a third leg and a fourth leg, and the second support bar, where the second support bar connects the third leg and the fourth leg, and where the second support bar is disposed below the second gripping bar along the z-axis; and a central support structure connecting the first side structure to the second side structure. The method may further include placing a body part on the resistance band, and, while gripping at least a portion of each of the first gripping bar the second gripping bar, performing a dipping motion downward along the z-axis, where the resistance band provides an upward force counteracting a weight of a user performing the dip exercise.

Implementations may include one or more of the following features. The method may further include positioning the dip apparatus for the dip exercise by pivoting each of the first side structure and the second side structure away from the central support structure such that the first side structure and the second side structure are aligned substantially parallel to one another. The method may further include locking a position of each of the first side structure and the second side structure. The method may further include positioning the dip apparatus for storage by pivoting each of the first side structure and the second side structure toward the central support structure such that the first side structure and the second side structure are substantially aligned with the central support structure thereby reducing a footprint of the dip apparatus. The method may further include locking a position of each of the first side structure and the second side structure. The method may further include adjusting one or more of the first leg, the second leg, the third leg, and the fourth leg along the z-axis to relocate one or more of the first gripping bar and the second gripping bar along the z-axis. The method may further include locking a position of one or more of the first leg, the second leg, the third leg, and the fourth leg along the z-axis.

These and other features, aspects, and advantages of the present teachings will become better understood with reference to the following description, examples, and appended claims.

BRIEF DESCRIPTION OF THE DRAWINGS

The foregoing and other objects, features, and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In the drawings, like reference numerals generally identify corresponding elements.

DETAILED DESCRIPTION

Figure 1:
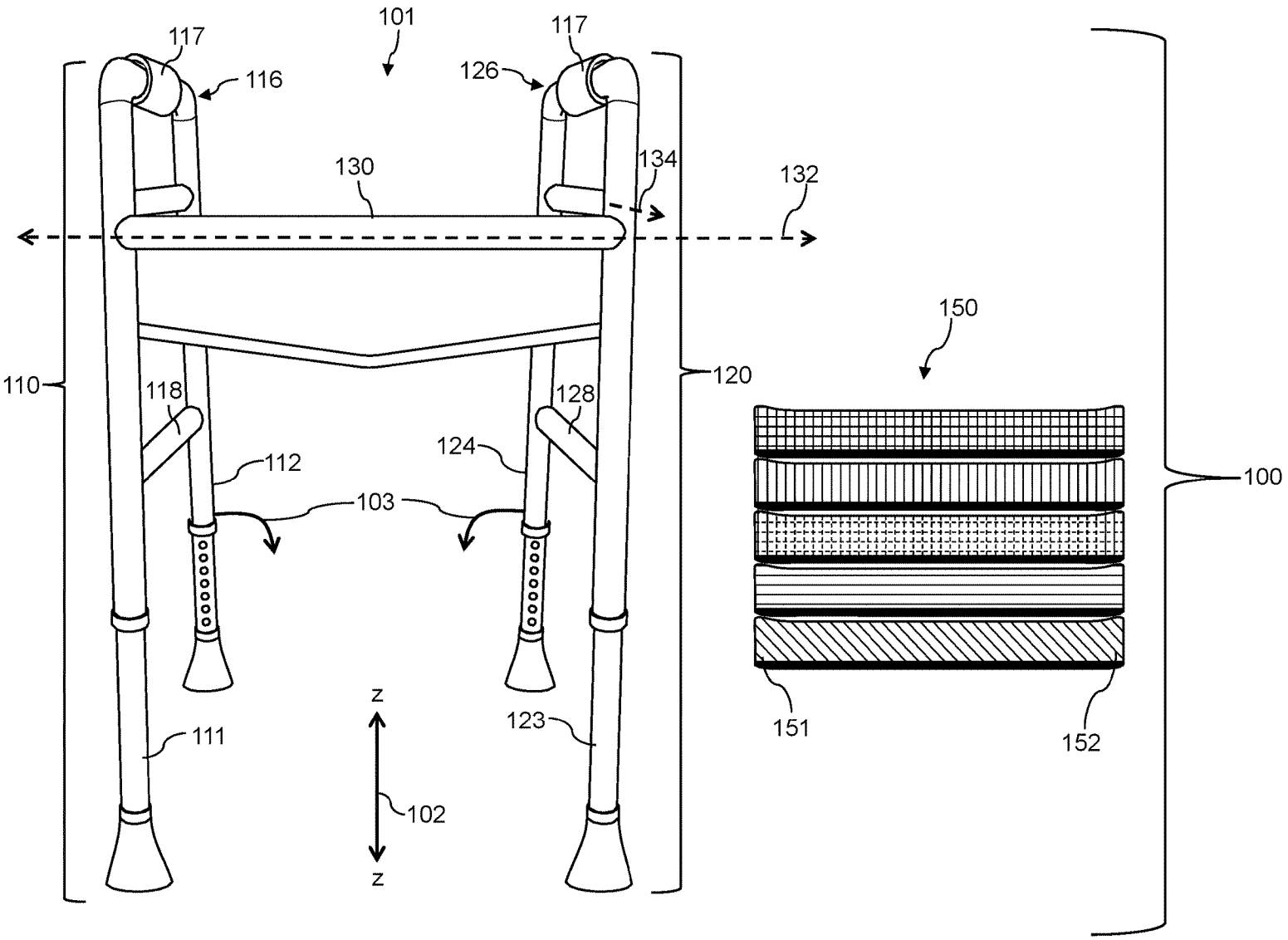
FIG. 1 illustrates an exercise system, in accordance with a representative embodiment.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately" or the like, when accompanying a numerical value, are to be construed as indicating a deviation as would be appreciated by one of ordinary skill in the art to operate satisfactorily for an intended purpose. Similarly, words of approximation such as "about," "approximately," or "substantially" when used in reference to physical characteristics, should be understood to contemplate a range of deviations that would be appreciated by one of ordinary skill in the art to operate satisfactorily for a corresponding use, function, purpose, or the like. Ranges of values and/or numeric values are provided herein as examples only, and do not constitute a limitation on the scope of the described embodiments. Where ranges of values are provided, they are also intended to include each value within the range as if set forth individually, unless expressly stated to the contrary. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," "above," "below," and the like, are words of convenience and are not to be construed as limiting terms unless specifically stated to the contrary.

In general, the devices, systems, and methods disclosed herein relate to exercise, fitness, health, rehabilitation, and the like. In particular, an aspect of the present teachings is related to a system for performing dip exercises featuring a collapsible and portable dip apparatus, and resistance bands that are engageable thereto, e.g., to provide upward assistance for a user of the system. In this manner, the present teachings may represent various, salient improvements over existing, comparable exercise equipment and systems such as being relatively easily portable, being relatively easily adjustable, being relatively inexpensive, and featuring a solution to provide assistance to users that may require or desire such adaptivity. That is, many existing dip exercise systems are bulky, expensive, non-collapsible, non-adjustable, and/or that do not include any mechanism for providing upward assistance for a user. In particular, many less-cumbersome home dip mechanisms that may be storable often do not provide upward assistance for a user, thus limiting their use to those users that are capable or desirous of performing a dip exercise without assistance. In contrast, many commercial, professional-grade dip exercise systems (such as those in commercial gyms, educational facilities, and training facilities) may provide relatively complex platform systems with pulleys/weights for providing assistance to users performing dip exercises, but these dip exercise systems are often cumbersome, expensive, and/or difficult to use. The present teachings may thus provide advantages over existing systems and devices by being collapsible, portable, easy to use, adjustable, and accommodatable to a user desiring or requiring support and/or upward assistance when performing a dip exercise.

It will be understood that, while the present teachings may emphasize use of the exercise devices, systems, and methods for performing dip exercises (assisted by resistance bands, or unassisted), the scope of the present teachings should not be limited to such exercises. Thus, the techniques disclosed herein may be adapted for use for other exercises including without limitation one or more of pull-ups, push-ups, and the like, among others. As such, all such embodiments are intended to be included herein.

FIG. 1 illustrates an exercise system, in accordance with a representative embodiment. In general, the system 100 may include a dip apparatus 101 and one or more resistance bands 150 that are engageable thereto, e.g., to provide support and/or upward assistance to a user when performing a dip exercise (or other exercise) using the dip apparatus 101. The dip apparatus 101 may be collapsible and/or portable as described herein. The dip apparatus 101 may generally include a first side structure 110, a second side structure 120, and a central support structure 130.

The first side structure 110 may include a first gripping bar 116 supported by a first leg 111 and a second leg 112. The first leg 111 and the second leg 112 may be adjustable and/or lockable along a z-axis 102 to relocate the first gripping bar 116 along the z-axis 102, e.g., for adjusting the height of one or more components of the first side structure 110. For example, adjustment and/or locking of the first gripping bar 116 along the z-axis 102 may be provided by a wing nut, a spring loaded element, or the like that is engageable with one or more positioning holes disposed along a portion of one or more of the first leg 111 and the second leg 112. In this manner, adjustment and/or locking of the first gripping bar 116 along the z-axis 102 may utilize the same height-adjustment mechanism, or a similar mechanism, to those found on crutches, walkers, canes, and the like.

The first side structure 110 may further include a first support bar 118 connecting the first leg 111 and the second leg 112. The first support bar 118 may be disposed below the first gripping bar 116 along the z-axis 102 as shown in the figure. The first support bar 118 may be structurally configured for engagement with one or more resistance bands 150. It will be understood that, although shown as connected to both the first leg 111 and the second leg 112, the first support bar 118 may instead be connected to only one of these legs and/or to another component of the dip apparatus 101—e.g., the first support bar 118 may be cantilevered from one or more components of the dip apparatus 101. Also or instead, the first support bar 118 may include one or more sections, and/or the first support bar 118 may be movable relative to another component of the dip apparatus 101, for example to accommodate mating with an end of a resistance band 150 (e.g., by looping or hooking a resistance band 150 thereabout). By way of example, the first support bar 118 may include at least two portions that are selectively engageable and releasable relative to one another (and/or relative to another component of the dip apparatus 101). In this manner, when the first support bar 118 is disposed in a unengaged state, an end of a resistance band 150 may be slipped onto or otherwise engaged with a free end of a portion of the first support bar 118, where the portions thereof can then be reengaged before use of the dip apparatus 101 with the resistance band 150 coupled thereto. By way of further example, a portion of the first support bar 118 may be pivotable along the z-axis 102 (e.g., in an upward direction) for freeing an end of the first support bar 118 to accommodate engagement with a resistance band 150, and pivotable back (e.g., downward along the z-axis 102) into engagement to recouple the end of the first support bar 118 after engagement with the resistance band 150.

The second side structure 120 may be disposed opposite the first side structure 110 and aligned substantially parallel to the first side structure 110 when the dip apparatus 101 is positioned for a dip exercise, where the dip apparatus 101 is so positioned in FIG. 1. The second side structure 120 may be the same or similar to the first side structure 120 and may thus include any of the features described above with reference to the first side structure 120 (and vice-versa), e.g., the second side structure 120 may mirror the first side structure 110. For example, the second side structure 120 may include a second gripping bar 126 disposed opposite the first gripping bar 116. And the second gripping bar 126 may be supported by a third leg 123 and a fourth leg 124, where the third leg 123 and the fourth leg 124 are adjustable and/or lockable along the z-axis 102 to relocate the second gripping bar 126 along the z-axis 102. The adjustment and/or locking mechanism for the second gripping bar 126 along the z-axis 102 may be the same as, or similar to, that used for adjustment and/or locking of the first gripping bar 116 along the z-axis 102.

The second side structure 120 may include a second support bar 128 connecting the third leg 123 and the fourth leg 124. The second support bar 128 may be disposed below the second gripping bar 126 along the z-axis 102. The second support bar 128 may be structurally configured for engagement with one or more resistance bands 150. The second support bar 128 may be the same or similar to the first support bar 118 and may thus include any of the features described above with reference to the first support bar 118 (and vice-versa), e.g., the second support bar 128 may mirror the first support bar 118.

The central support structure 130 may connect the first side structure 110 to the second side structure 120. When the dip apparatus 101 is positioned for a dip exercise (e.g., in the configuration shown in FIG. 1), the central support structure 130 may be aligned along a central axis 132 that is intersected by an axis 134 disposed through the first side structure 110 and the second side structure 120. For example, in certain aspects, when positioned for a dip exercise, an axis 134 disposed through the first side structure 110 and the second side structure 120 (such that this axis 134 is substantially aligned with the first gripping bar 116 and the second gripping bar 126—e.g., where this axis 134 would traverse into and out of the page when looking at FIG. 1) may be substantially perpendicular to the central axis 132 disposed through the central support structure 130.

However, when the dip apparatus 101 is positioned for storage, each of the first side structure 110 and the second side structure 120 may be substantially aligned along the same axis—the central axis 132—as the central support structure 130 (e.g., at least within 30-degrees of alignment to this central axis 132). To this end, in an aspect, each of the first side structure 110 and the second side structure 120 are pivotable (or otherwise movable) towards the central support structure 130 thereby reducing a footprint of the dip apparatus 101 when the dip apparatus 101 is positioned for storage. For example, the second leg 112 and the fourth leg 124 in the figure may be movable toward the central support structure 130 in the direction of arrows 103 in the figure. A hinge or similar—e.g., disposed between the central support structure 130 and one or more of the first side structure 110 and the second side structure 120—may be provided to accommodate such movement of the first side structure 110 and the second side structure 120.

The system 100 may further include one or more resistance bands 150 as stated above and described herein. A resistance band 150 of the one or more resistance bands 150 may be structurally configured to engage with the first support bar 118 and the second support bar 128 of the dip apparatus 101, and/or another portion of the dip apparatus 101. For example, a resistance band 150 may include a first end 151 and a second end 152, where each of the first end 151 and the second end 152 is structurally configured to engage with one or more of the first support bar 118 and the second support bar 128. Continuing with this example, in an aspect, the resistance band 150 may include a hook or the like disposed on each of the first end 151 and the second end 152, e.g., for hooking into or around one or more of the first support bar 118 and the second support bar 128 for engagement thereto, and/or for hooking together or otherwise coupling the first end 151 and the second end 152 of the resistance band 150 after looping the resistance band 150 around the first end 151 and the second end 152. Other couplers are also or instead possible for inclusion on ends of the resistance band 150. Regardless of how it is accomplished, a resistance band 150 may be engageable with the first support bar 118 and the second support bar 128 in a manner such that the resistance band 150 is relatively stable on the dip apparatus 101, e.g., for a user to place at least a portion of their weight on the resistance band 150 when performing a dip exercise. For example, in use, a user may place his/her knees on the resistance band 150 for upward support when performing a dip exercise. In this manner, the resistance bands 150 may be structurally configured for assisting a user in performing a dip exercise when one or more resistance bands 150 are engaged with the dip apparatus 101. That is, the resistance bands 150 may actually be thought of as "assistance bands" or the like.

It should be noted that a resistance band 150 may also or instead be engageable with another portion of the dip apparatus 101, e.g., in addition to or instead of the first support bar 118 and the second support bar 128. For example, a resistance band 150 and/or a portion of the dip apparatus 101 may be configured for engagement between one or more of the legs of the dip apparatus 101 (or another portion of the first side structure 110 and/or the second side structure 120), the central support structure 130, and so on.

A resistance band 150 may be made from an elastic material, e.g., rubber and the like. In a system 100 including a set of resistance bands 150, the set of resistance bands 150 may include at least two resistance bands 150 each having a different modulus of elasticity. For example, the set of resistance bands 150 may include three or more resistance bands 150, where each of the three or more resistance bands 150 has a different modulus of elasticity. Any number of resistance bands 150 is also or instead possible. It shall be generally understood that the different modulus of elasticity of the resistance bands 150 would equate to a different resistance (through a different degree of flexing) for a user performing a dip exercise. Stated otherwise, the more a resistance band 150 flexes when supporting a user's weight, the less support the resistance band 150 will provide for a user performing a dip exercise. And, in this manner, different resistance bands 150 having different flexibilities may be included in the system 100. For example, the different resistance bands 150 shown in the figures may each be structurally configured to have a different modulus of elasticity, and therefore to provide a different level of support for a user. And, in this manner, it will be understood that the different resistance bands 150 shown in the figures generally have different hatching/shading patterns to represent the different modulus of elasticities thereof, or another property difference between the resistance bands 150. In certain implementations, more than one resistance band 150 may be utilized on the dip apparatus 101 for assisting a user in performing a dip exercise. To this end, the resistance bands 150 may be disposed adjacent to one another on the dip apparatus 101—e.g., on top of one another, and/or side by side.

As discussed above, the height of the dip apparatus 101 may be adjustable, e.g., to accommodate users of differing sizes. For example, the first leg 111, the second leg 112, the third leg 123, and the fourth leg 124 may be independently adjustable along the z-axis 102. In another aspect, the first leg 111 and the second leg 112 adjust in a cooperating manner, and the third leg 123 and the fourth leg 124 adjust in a cooperating manner. The first leg 111, the second leg 112, the third leg 123, and the fourth leg 124 may also or instead include feet thereon, which may also or instead be adjustable (e.g., to achieve different stability through changing the size or shape of the feet, and/or to change the height of the dip apparatus 101). The feet may be formed of a shape conducive for stability, or otherwise structurally configured for exercising using the dip apparatus 101. For example, the feet may include a cross section shaped as a square, a rectangle, a circle or other rounded shape such as an oval, a triangle, a star, a clover, a cross, a diamond, and so on. The feet may also or instead include a material selected to provide a relatively large amount of friction with the ground upon which the dip apparatus 101 sits upon e.g., the material may include a rubber or the like.

Also, or instead, the first gripping bar 116 and the second gripping bar 126 may each be adjustable along the z-axis 102. For example, the first gripping bar 118 and the second gripping bar 128 may each be adjustable along the z-axis 102 through adjustment of the legs of the dip apparatus 101. Also, or instead, the first gripping bar 116 and the second gripping bar 126 may each be adjustable along the z-axis 102 independent or otherwise separate from the adjustability of the legs of the dip apparatus 101. Thus, in an aspect, the first gripping bar 116 and the second gripping bar 126 may each be adjustable along the z-axis 102 relative to the z-axis height of one or more of the first support bar 118 and the second support bar 128. The adjustment mechanism for one or more of the first gripping bar 116 and the second gripping bar 126 may be the same as or similar to any as described herein, e.g., with reference to the legs of the dip apparatus 101.

Also, or instead, the first support bar 118 and the second support bar 128 may each be adjustable along the z-axis 102. For example, the first support bar 118 and the second support bar 128 may each be adjustable along the z-axis 102 through adjustment of the legs of the dip apparatus 101. Also, or instead, the first support bar 118 and the second support bar 128 may each be adjustable along the z-axis 102 independent or otherwise separate from the adjustability of the legs of the dip apparatus 101. In an aspect, the first support bar 118 and the second support bar 128 may each be adjustable relative to a z-axis height of the first gripping bar 116 and the second gripping bar 126. In this manner, the first support bar 118 and the second support bar 128 may be slidable and lockable along one or more of the legs of the dip apparatus 101. Also or instead, the adjustment mechanism for one or more of the first support bar 118 and the second support bar 128 may be the same as or similar to any as described herein, e.g., with reference to the adjustment mechanisms for the legs of the dip apparatus 101. Stated otherwise, adjustment of one or more of the aforementioned components may be provided by ball lock pins, sliders, wing nuts, bolts, screws, tensioners, or the like.

In an aspect, each of the first gripping bar 116 and the second gripping bar 126 includes a handle 117. The handle 117 may simply include a designated gripping region disposed along each of the first gripping bar 116 and the second gripping bar 126, e.g., a region structurally configured for a user to hold onto when performing a dip exercise. In some aspects, this gripping region includes a softer material than that of the first gripping bar 116 and the second gripping bar 126. For example, the gripping region may include a foam material and/or a rubber material, and the first gripping bar 116 and the second gripping bar 126 may include a harder material such as metal or plastic. In some aspects, the handle 117 protrudes from the first gripping bar 116 and the second gripping bar 126. In other aspects, the handle 117 includes an indention in the first gripping bar 116 and the second gripping bar 126.

Figure 2:
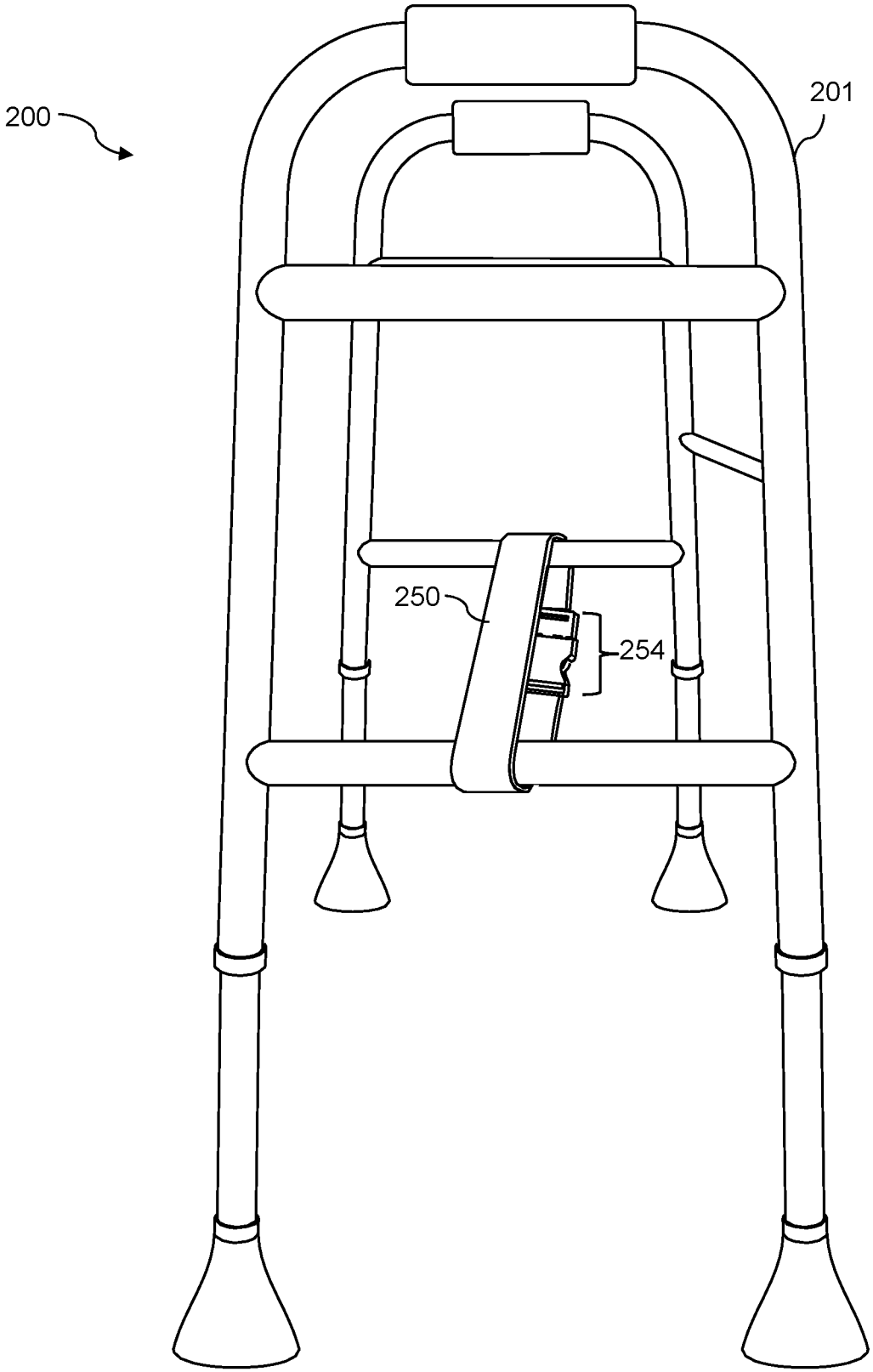
FIG. 2 illustrates a side view of an exercise system, in accordance with a representative embodiment.

FIG. 2 illustrates a side view of an exercise system, in accordance with a representative embodiment. The system 200 shown in FIG. 2 may be the same or similar to that shown in FIG. 1, but where a resistance band 250 is positioned for use on the dip apparatus 201. It will be understood, however, that more than one resistance band 250 may be positioned for use on the dip apparatus 201.

As shown in FIG. 2, an embodiment of a resistance band 250 that may be used on the dip apparatus 201 may include a coupler 254, which may be comprised of a first connector and a second connector that are engageable with one another to provide stability for the resistance band 250 (e.g., by forming a continuous loop that is releasably locked in that configuration, and that is disposed around at least a portion of the dip apparatus 201). For example, the coupler 254 may include a clip, a buckle, a clasp, and the like.

Figure 3:
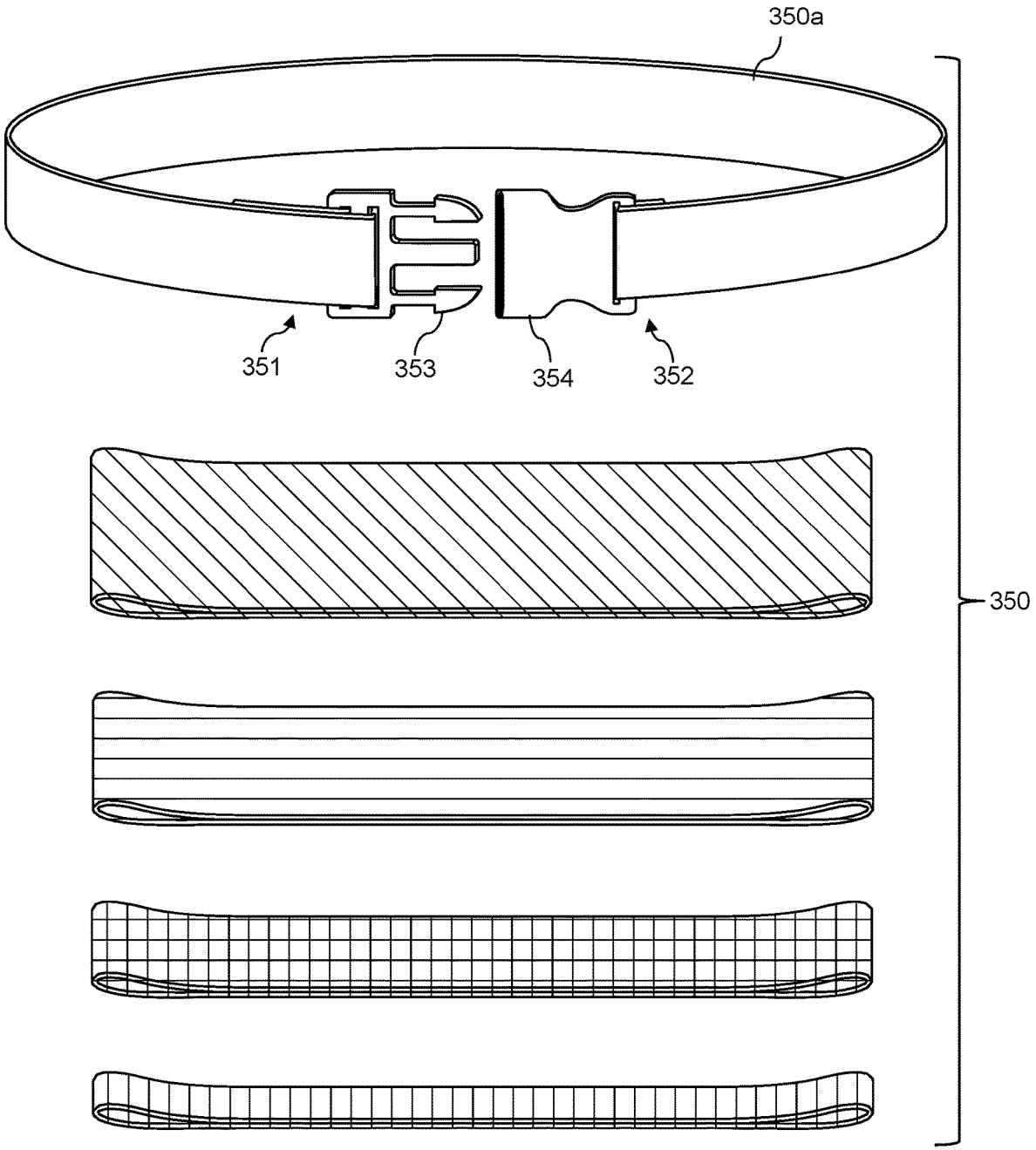
FIG. 3 illustrates resistance bands for use in an exercise system, in accordance with a representative embodiment.

FIG. 3 illustrates resistance bands for use in an exercise system, in accordance with a representative embodiment. As shown in this figure, different resistance bands 350 may include different sizes, shapes, couplers, and the like. For example, the resistance bands 350 may be structurally configured to provide different resistance (and thus different assistance to a user performing a dip exercise or the like using a dip apparatus as described herein) through their shape, e.g., as dictated by the thicknesses of the resistance bands 350. For example, from thickest to thinnest, the resistance bands 350 shown may support, and thus provide assistance equating to, 150 lbs., 130 lbs., 120 lbs., and 100 lbs.—however, it will be understood that the sizes, shapes, and other attributes of the resistance bands 350 are provided by way of example and can be different from that shown.

As similarly shown in the figure, a resistance band 350 may be formed as a continuous loop (e.g., to be slipped onto and looped around one or more portions of a dip apparatus according to the present teachings), or a resistance band 350 may include free ends, where such free ends may be couplable to each other and/or a component of a dip apparatus according to the present teachings.

In particular, as demonstrated by a first resistance band **350*a* in the figure, the first resistance band 350*a* may include a first end 351 including a first connector 353 and a second end 352 including a second connector 354, where the first connector 353 and the second connector 354 are attachable to one another and/or to a component of a dip apparatus according to the present teachings. For example, and as shown in the figure, one or more of the first connector 353 and the second connector 354 may include portions of a clip, a buckle, a clasp, or the like. Also or instead, one or more of the first connector 353 and the second connector 354 may include a hook or the like. Also or instead, the first connector 353 may include a protrusion, and the second connector 354 may include a void to receive the protrusion of the first connector 353 (or vice-versa). Other configurations for such connectors are also or instead possible. For example, connectors on ends of a resistance band 350 may include one or more of a dowel, hook and loop connectors, mechanically keying features, a latch, a pin, a screw, a slider, a snap, and so on. And, as described herein, the connectors may be structurally configured for releasably securing free ends of a resistance band 350** to one another and/or to a portion of a dip apparatus according to the present teachings such as the support bars described herein.

Figure 4:
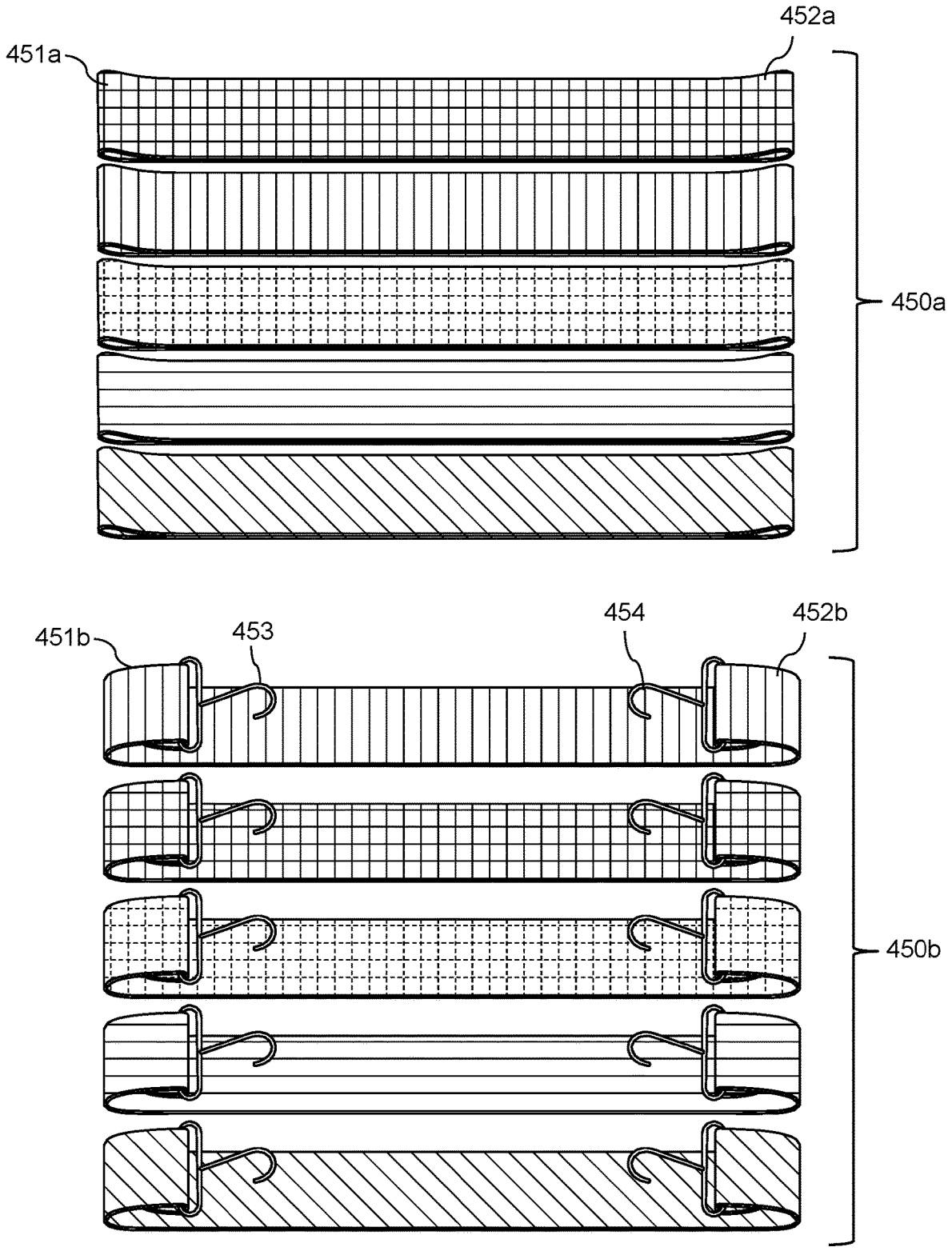
FIG. 4 illustrates resistance bands for use in an exercise system, in accordance with a representative embodiment.

FIG. 4 illustrates resistance bands for use in an exercise system, in accordance with a representative embodiment.

Specifically, this figure shows two sets of resistance bands—a first set 450*a* and a second set 450*b* of resistance bands—where it will be understood that more or less, and/or different types of, resistance bands are possible for use in the present teachings. The different hatching/shading shown on the resistance bands may represent different attributes of a resistance band relative to others in the set of resistance bands—and, it will be understood that the hatching is merely shown by way of example, as other forms of demarcation such as labeling (e.g., with words, numbers, letters, properties, measurements, and the like) and/or coloring are also or instead possible. For example, the marking of a resistance band may represent a specific modulus of elasticity for the resistance band, where this modulus of elasticity correlates to the amount of assistance a particular resistance band would provide for a user when the resistance band is engaged with a dip apparatus according to the present teachings and the user performs a dip exercise or the like while engaged with the resistance band (e.g., with the user's knees on the resistance band thereby providing support for the user).

Resistance bands in the first set 450*a* may include continuous loops, where these resistance bands can be looped about a portion of a dip apparatus such as one or more of a first support bar and a second support bar as described herein. To accommodate such looping about, these portions of the dip apparatus may include slots or free ends for placing one or more continuous loop resistance bands thereabout, and/or these portions of the dip apparatus may be movable to expose an end about which to place one or more continuous loop resistance bands. These portions of the dip apparatus may also or instead include one or more features for locking a resistance band in engagement with the dip apparatus, e.g., for safety when in use.

Resistance bands in the first set 450*a* may also or instead include ends that form loops or the like—on a first end 451*a* and a second end 452*a* thereof. These ends may thus be configured for looping about one or more portions of a dip apparatus such as a first support bar and a second support bar as described herein. Thus, engagement of a resistance band to a dip apparatus may include looping or wrapping a resistance band about one or more portions of a dip apparatus such as a first support bar and a second support bar as described herein—where it will be understood that the ends (or the resistance band overall) may be structurally configured to accommodate such looping or wrapping for engagement. Other affixing means are also or instead possible, as will be understood by a skilled artisan.

A resistance band—such as those shown in the second set 450*b*—may also or instead include an end that is structurally configured for at least one of (i) affixing to an opposing end of the resistance band, and/or (ii) affixing to one or more portions of a dip apparatus such as a first support bar and a second support bar as described herein. In this manner, and as shown in the figure, the first end 451*b* of a resistance band may include a first connector 453 and a second end 452*b* of a resistance band may include a second connector 454, where the second connector 454 may be the same type of connector (and/or a corresponding/mating connector) or a different type of connector as the first connector 453. By way of example, and as shown in the figure, one or more of the first connector 453 and the second connector 454 (e.g., each of the first connector 453 and the second connector 454) may include a hook or the like. Such a hook or the like may be structurally configured for at least one of (i) affixing to an opposing end of the resistance band (e.g., to an opposing hook or the like), e.g., after wrapping the resistance band about a portion of a dip apparatus, and/or (ii) affixing to one or more portions of a dip apparatus such as a first support bar and a second support bar as described herein, such as by hooking around or through such a support bar. As described herein, other forms of connectors are also or instead possible for the resistance bands. Similarly, one or more portions of a dip apparatus such as a first support bar and a second support bar as described herein may include specific mating features to facilitate engagement with a resistance band such as one or more of a void, a protrusion, a free end, and the like.

Figure 5:
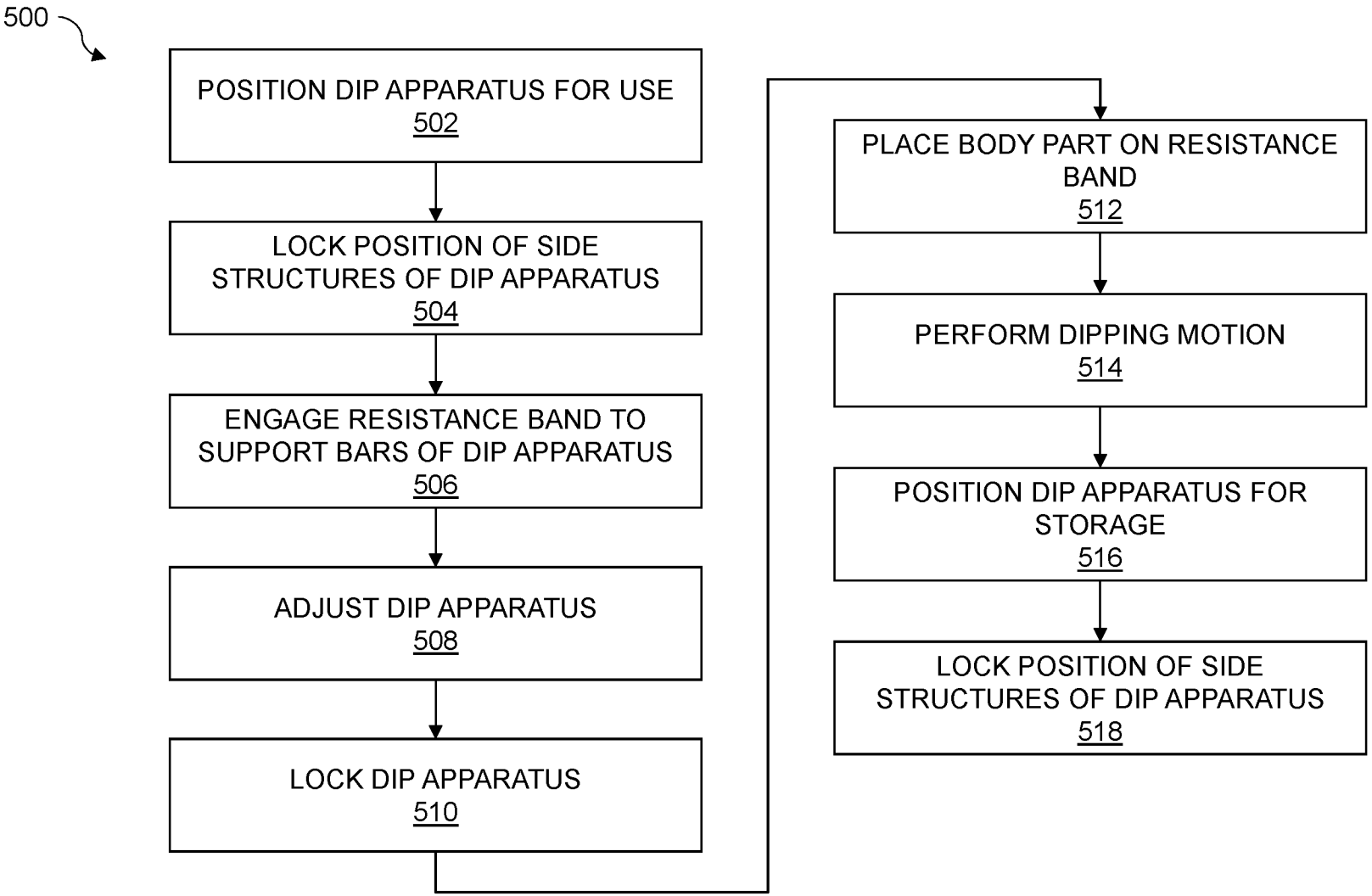
FIG. 5 is a flow chart of a method of performing a dip exercise, in accordance with a representative embodiment.

FIG. 5 is a flow chart of a method of performing a dip exercise, in accordance with a representative embodiment. It will be understood that the method 500 may be performed, e.g., using any of the devices, apparatuses, and systems described above. For example, the method 500 may be performed using a collapsible and portable dip apparatus including a first side structure comprising a first gripping bar supported by a first leg and a second leg, where the first leg and the second leg are adjustable along a z-axis to relocate the first gripping bar along the z-axis, and a first support bar connecting the first leg and the second leg, where the first support bar is disposed below the first gripping bar along the z-axis. The dip apparatus may further include a second side structure disposed opposite the first side structure and aligned substantially parallel to the first side structure when the dip apparatus is positioned for a dip exercise. The second side structure may include a second gripping bar disposed opposite the first gripping bar, where the second gripping bar is supported by a third leg and a fourth leg, and where the third leg and the fourth leg are adjustable along the z-axis to relocate the second gripping bar along the z-axis. The second support bar may connect the third leg and the fourth leg, where the second support bar disposed below the second gripping bar along the z-axis. The dip apparatus may further include a central support structure connecting the first side structure to the second side structure, where each of the first side structure and the second side structure are pivotable towards the central support structure thereby reducing a footprint of the dip apparatus when the dip apparatus is positioned for storage.

As shown in step 502, the method 500 may include positioning the dip apparatus for a dip exercise. This may be accomplished by pivoting each of the first side structure and the second side structure of the dip apparatus away from the central support structure such that the first side structure and the second side structure are aligned substantially parallel to one another, and/or substantially perpendicular to the central support structure. Stated otherwise, this step 502 may include manipulating the dip apparatus from a position for storage (e.g., a collapsed position) to a position for exercise (e.g., an expanded or open position). And this may include moving one or more of the side structures from a position substantially aligned with a central support structure of the dip apparatus to a position where at least one end of the side structure(s) is disposed away from the central support structure.

It will be understood that positioning the dip apparatus for a dip exercise may also or instead include attaching or moving legs thereof, or otherwise unstowing components of the dip apparatus from a storage position to an exercise position, and/or adjusting the dip apparatus for a user.

As shown in step 504, the method 500 may include locking a position of each of the first side structure and the second side structure. This may include locking a position of these structures overall—e.g., locking the first side structure and the second side structure in an expanded or open position, after moving from a stowed or closed position along the central support structure of the dip apparatus. In this manner, this may include the use of a hinge or joint that is similar to those found in folding tables and the like. This step 504 may also or instead include locking a position of a subcomponent of one or more of the first side structure and the second side structure, such as one or more legs thereof. This may include the use of a ball lock pin and the like. Therefore, locking a position of each of the first side structure and the second side structure may include locking a position along one or more of a first axis (e.g., a z-axis for height adjustments) and a second axis intersecting the first axis (e.g., one or more of an x- or y-axis for moving structures between a stowed position and an unstowed position).

As shown in step 506, the method 500 may include engaging a resistance band to the first support bar and the second support bar of the dip apparatus, and/or to another portion(s) of the dip apparatus. Engaging a resistance band in this manner may include hooking ends of the resistance band, and/or other portions of the resistance band, around a circumference of a portion of the dip apparatus (e.g., the first support bar and the second support bar). To this end, the ends of the resistance band may include hook-shaped ends or the like, which may be structurally configured for engagement with the first support bar and the second support bar. Engaging a resistance band in this manner may also or instead include using a fastener such as one or more of a bolt, a clamp, a clip, a dowel, a gib, hook and loop, a nail, a nut, a pin, a screw, a slider, a snap, and so on. In some implementations, a resistance band is formed of a continuous loop, where, in such implementations, engaging a resistance band to the first support bar and the second support bar of the dip apparatus (and/or to another portion of the dip apparatus) may include removal and/or movement of a portion of these elements such that the resistance band can be slid thereupon or otherwise placed around these elements. And, in some implementations, a resistance band includes a buckle or the like (e.g., a clip) that can be selectively engageable to form a continuous loop. Thus, engaging a resistance band to the first support bar and the second support bar of the dip apparatus (and/or to another portion of the dip apparatus) may include clipping and/or buckling ends of the resistance band together after traversing the resistance band about these support bars or other structures. It will be understood that engaging a resistance band may include engaging a plurality of resistance bands, e.g., to adjust resistance thereof (and more particularly to adjust the assistance provided to a user when performing a dip exercise). When multiple resistance bands are placed for use on the dip apparatus, they may be placed on top of one another, side-by-side, spaced apart, and combinations thereof.

As shown in step 508, the method 500 may include adjusting the dip apparatus—e.g., adjusting one or more of the first leg, the second leg, the third leg, and the fourth leg along the z-axis to relocate one or more of the first gripping bar and the second gripping bar along the z-axis. This step 508 may also or instead include other adjustments to accommodate a user's physical features (e.g., height, weight, etc.), a user's abilities, and so on.

As shown in step 510, the method 500 may include locking the dip apparatus in a position—e.g., locking a position of one or more of the first leg, the second leg, the third leg, and the fourth leg along the z-axis. This may also or instead include locking a position of one or more resistance bands on the dip apparatus.

As shown in step 512, the method 500 may include placing a body part on the resistance band. This may include a knee of a user (e.g., both knees of a user) or another portion of a user's legs and/or feet, a user's rear end (e.g., gluteus maximus), and/or another portion of a user's body. In an embodiment where the dip apparatus is used for an exercise other than dips, such as a push up, this may include placing a portion of a user's arms (e.g., their hands) on the resistance bands, or placing a portion of a user's legs (e.g., their feet) on the resistance bands but while the user is in a substantially prone position. Thus, in this manner and as described herein, it will be understood that the dip apparatus may be used for different exercises besides dips.

As shown in step 514, the method 500 may include, while gripping at least a portion of each of the first gripping bar the second gripping bar, performing a dipping motion (e.g., downward) along the z-axis. When performing such a dip exercise, the resistance band may provide an upward force counteracting a weight of a user performing the dip exercise. Other exercises are also or instead possible as described herein.

As shown in step 516, the method 500 may include positioning the dip apparatus for storage, e.g., by pivoting each of the first side structure and the second side structure toward the central support structure such that the first side structure and the second side structure are substantially aligned with the central support structure thereby reducing a footprint of the dip apparatus (or such that they are otherwise aligned to reduce a footprint of the dip apparatus for storage or the like). This may also or instead include stowing and/or disengaging one or more other components of the dip apparatus. For example, the legs (or more generally the side structures of the dip apparatus) may be moved such that the z-axis height of the dip apparatus is reduced for storage and the like.

As shown in step 518, the method 500 may include locking a position of each of the first side structure and the second side structure, e.g., in a stowed position for storage of the dip apparatus. This step 518 may also or instead include locking and/or stowing other components of a dip apparatus.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings.

Unless the context clearly requires otherwise, throughout the description, the words "comprise," "comprising," "include," "including," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example performing the step of X includes any suitable method for causing another party such as a remote user, a remote processing resource (e.g., a server or cloud computer) or a machine to perform the step of X. Similarly, performing steps X, Y, and Z may include any method of directing or controlling any combination of such other individuals or resources to perform steps X, Y, and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. An exercise system, comprising:

a collapsible and portable dip apparatus, the collapsible and portable dip apparatus comprising:

a first side structure comprising:

a first gripping bar supported by a first leg and a second leg, wherein the first leg and the second leg are adjustable along a z-axis to relocate the first gripping bar along the z-axis; and a first support bar connecting the first leg and the second leg, the first support bar disposed below the first gripping bar along the z-axis;

a second side structure disposed opposite the first side structure and aligned parallel to the first side structure when the collapsible and portable dip apparatus is positioned for a dip exercise, the second side structure comprising:

a second gripping bar disposed opposite the first gripping bar, the second gripping bar supported by a third leg and a fourth leg, wherein the third leg and the fourth leg are adjustable along the z-axis to relocate the second gripping bar along the z-axis; and a second support bar connecting the third leg and the fourth leg, the second support bar disposed below the second gripping bar along the z-axis; and a central support structure connecting the first side structure to the second side structure, wherein each of the first side structure and the second side structure are pivotable towards the central support structure thereby reducing a footprint of the collapsible and portable dip apparatus when the collapsible and portable dip apparatus is positioned for storage; and one or more resistance bands, wherein a resistance band of the one or more resistance bands includes a first end having a first connector and a second end including a second connector, wherein the resistance band is structurally configured to loop around the first support bar and the second support bar and to form a continuous loop thereabout by attaching the first connector and the second connector, and wherein the resistance band is structurally configured to receive knees of a user thereon when the user performs the dip exercise using the collapsible and portable dip apparatus, the resistance band providing upward assistance to the user when performing the dip exercise.

2. The exercise system of claim 1, wherein each of the first gripping bar and the second gripping bar include a handle.

3. The exercise system of claim 2, wherein the handle of each of the first gripping bar and the second gripping bar includes a gripping region.

4. The exercise system of claim 3, wherein the gripping region of each of the first gripping bar and the second gripping bar includes one or more of a foam material and a rubber material.

5. The exercise system of claim 1, wherein the resistance band is made from rubber.

6. The exercise system of claim 1, wherein the one or more resistance bands includes at least two resistance bands each having a different modulus of elasticity.

7. The exercise system of claim 1, wherein the first support bar and the second support bar are each adjustable along the z-axis.

8. A method of performing a dip exercise, the method comprising:

engaging a resistance band to a first support bar and a second support bar of a dip apparatus, the dip apparatus comprising:

a first side structure including a first gripping bar supported by a first leg and a second leg, and the first support bar, wherein the first support bar connects the first leg and the second leg, and wherein the first support bar is disposed below the first gripping bar along an z-axis;

a second side structure including a second gripping bar supported by a third leg and a fourth leg, and the second support bar, wherein the second support bar connects the third leg and the fourth leg, and wherein the second support bar is disposed below the second gripping bar along the z-axis; and a central support structure connecting the first side structure to the second side structure, wherein the resistance band includes a first end having a first connector and a second end having a second connector, and wherein engaging the resistance band to the first support bar and the second support bar includes looping the resistance band thereabout to form a continuous loop by attaching the first connector and the second connector;

placing knees of a user on the resistance band; and while gripping at least a portion of each of the first gripping bar and the second gripping bar, performing a dipping motion downward along the z-axis, wherein the resistance band provides an upward force counteracting a weight of the user performing the dip exercise thereby providing upward assistance to the user when performing the dip exercise.

9. The method of claim 8, further comprising positioning the dip apparatus for the dip exercise by pivoting each of the first side structure and the second side structure away from the central support structure such that the first side structure and the second side structure are aligned parallel to one another.

10. The method of claim 9, further comprising locking a position of each of the first side structure and the second side structure.

11. The method of claim 8, further comprising positioning the dip apparatus for storage by pivoting each of the first side structure and the second side structure toward the central support structure such that the first side structure and the second side structure are aligned with the central support structure thereby reducing a footprint of the dip apparatus.

12. The method of claim 11, further comprising locking a position of each of the first side structure and the second side structure.

13. The method of claim 8, further comprising adjusting one or more of the first leg, the second leg, the third leg, and the fourth leg along the z-axis to relocate one or more of the first gripping bar and the second gripping bar along the z-axis.

14. The method of claim 13, further comprising locking a position of one or more of the first leg, the second leg, the third leg, and the fourth leg along the z-axis.

* * * * *